US008579582B1

(12) United States Patent
Gehring

(10) Patent No.: US 8,579,582 B1
(45) Date of Patent: Nov. 12, 2013

(54) EFFICIENT DRYING FAN

(75) Inventor: Kenneth C. Gehring, Cottage Grove, WI (US)

(73) Assignee: Technologies Holdings Corp., Houston, TX (US)

( * ) Notice: Subject to any disclaimer, the term of this patent is extended or adjusted under 35 U.S.C. 154(b) by 2323 days.

(21) Appl. No.: 11/385,460

(22) Filed: Mar. 21, 2006

(51) Int. Cl.
*F04D 29/42* (2006.01)

(52) U.S. Cl.
USPC ..... 415/182.1; 415/220; 415/222

(58) Field of Classification Search
USPC ..... 415/218.1, 219.1, 220, 221, 361, 182.1, 415/222; 34/201, 218, 230, 232, 233, 618, 34/620, 622
See application file for complete search history.

(56) References Cited

U.S. PATENT DOCUMENTS

| | | | | | |
|---|---|---|---|---|---|
| 43,530 | A * | 7/1864 | Stillman | 34/237 |
| 2,554,602 | A * | 5/1951 | Sutton | 415/222 |
| 2,572,120 | A * | 10/1951 | Dixon | 415/121.3 |
| 2,582,532 | A * | 1/1952 | Dean | 415/211.2 |
| 2,583,374 | A * | 1/1952 | Hoffman | 454/344 |
| 2,593,217 | A * | 4/1952 | Sutton | 417/313 |
| 2,616,617 | A * | 11/1952 | Hill | 415/121.3 |
| 2,896,337 | A * | 7/1959 | Blythe | 34/218 |
| 3,286,368 | A * | 11/1966 | Thomas | 34/618 |
| 4,145,821 | A * | 3/1979 | Schantz | 34/237 |
| 5,747,773 | A * | 5/1998 | Griffin et al. | 219/130.1 |
| 5,772,500 | A | 6/1998 | Harvey et al. | |
| 5,893,216 | A | 4/1999 | Smith et al. | |
| 6,111,748 | A | 8/2000 | Bhatia | |
| 6,615,508 | B1 * | 9/2003 | Valle | 34/201 |
| 6,647,639 | B1 | 11/2003 | Storrer | |
| 7,007,403 | B1 * | 3/2006 | Studebaker | 34/90 |
| 7,201,563 | B2 * | 4/2007 | Studebaker | 415/209.3 |
| 2006/0067818 | A1 * | 3/2006 | Studebaker | 415/198.1 |
| 2007/0157485 | A1 * | 7/2007 | Andrisin et al. | 34/201 |

FOREIGN PATENT DOCUMENTS

| | | | |
|---|---|---|---|
| GB | 2414784 | A * | 12/2005 |
| JP | 358038319 | | 3/1983 |
| JP | 406042498 | | 2/1994 |

OTHER PUBLICATIONS

Injectidry Product Line, Injectidry Systems, Inc., website: http://www.injectidry.com/PRODUCTS.PDF (visited Feb. 17, 2004).
Dri-Eaz Ace Turbo Dryer—stackable airmover, website: http://www.dri-eaz.com/products/ace.html (visited Jan. 21, 2005).
Dry Air Force Air Movers at Jon-Don, website: http://www.jondon.com/galeforce/default.htm (visited Jan. 21, 2005).
Studebaker Enterprises, Inc. AirPath Dryer, website: http://www.studebakerenterprises.com/default_airpath.html (visited Apr. 24, 2006).

* cited by examiner

*Primary Examiner* — Edward Look
*Assistant Examiner* — Aaron R Eastman
(74) *Attorney, Agent, or Firm* — Andrus, Sceales, Starke & Sawall, LLP

(57) ABSTRACT

A drying fan has a shroud with a shape selected to improve fan efficiency by designated fluid dynamics of air flow through the fan.

3 Claims, 4 Drawing Sheets

EFFICIENT DRYING FAN

BACKGROUND AND SUMMARY

The invention relates to drying fans, including for water damage restoration.

In the water damage restoration industry, fans are used for drying a water damaged structure, including carpeting, furniture, framework, etc. If water can be evaporated quickly, damage can be minimized. The fans move air over the water damaged surfaces at high velocity.

The present invention arose during continuing development efforts directed toward drying fans, including higher efficiency enabled by improved fluid dynamics of the air flow through the fan.

DETAILED DESCRIPTION

Figure 1:
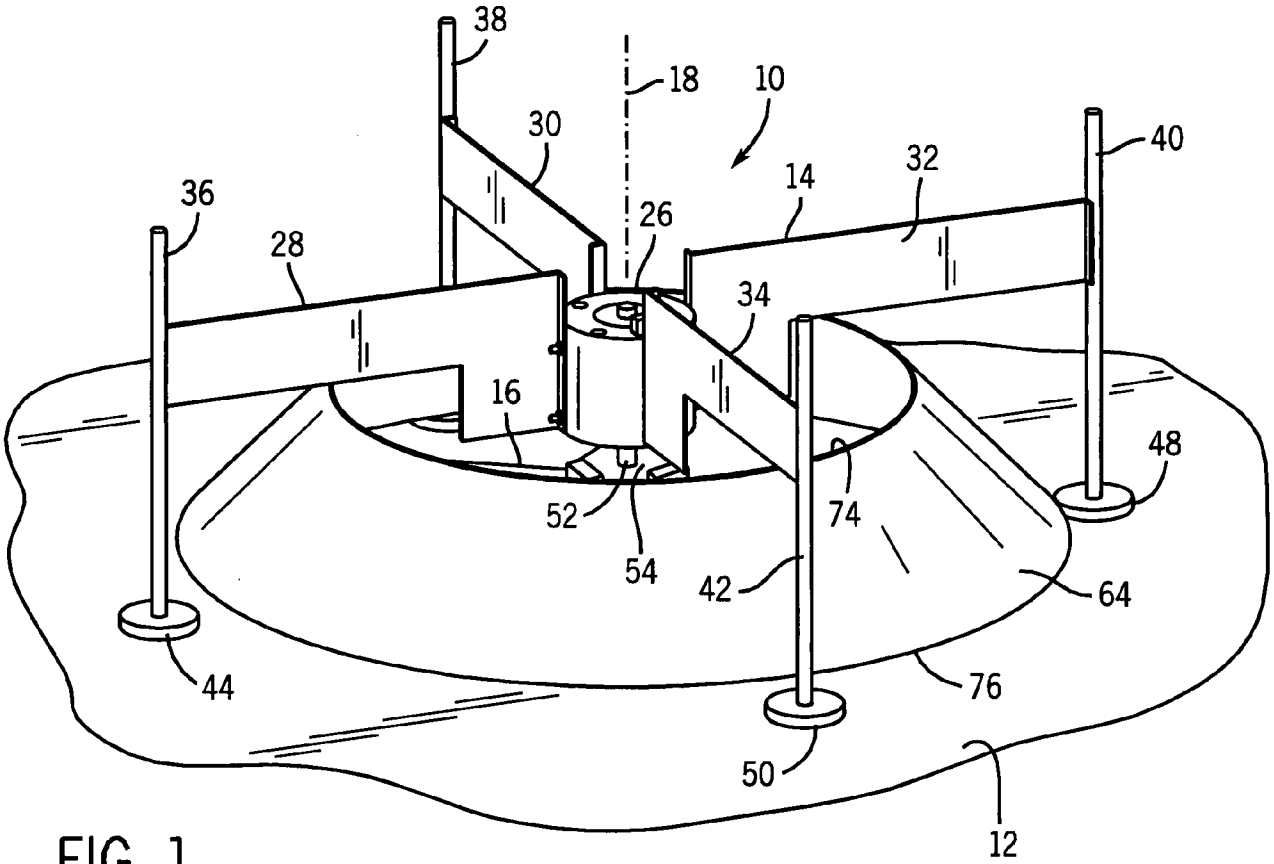
FIG. 1 is a perspective view of a drying fan constructed in accordance with the invention.
Figure 2:
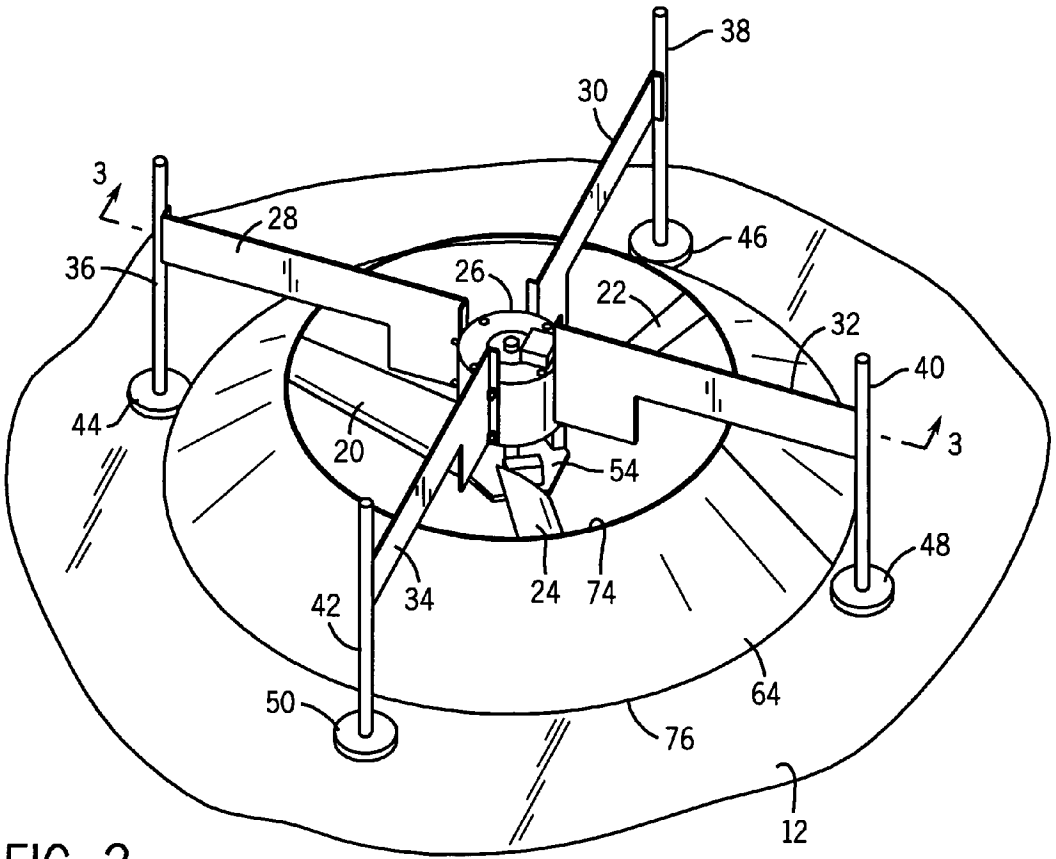
FIG. 2 is another perspective view of the drying fan of FIG. 1.

FIG. 1 shows a drying fan 10 for drying a surface 12, such as a water damaged floor, carpeting, etc. The fan includes a housing 14, a motor driven fan 16 supported on the housing for rotation about an axis 18 and having fan blades 20, 22, 24, FIGS. 2, 3, directing air axially and radially relative to axis 18. The fan blades are driven by motor 26 mounted to and supported by lateral arms 28, 30, 32, 34 which in turn are supported by respective legs 36, 38, 40, 42 having respective lower pads or feet 44, 46, 48, 50 resting on surface 12. The motor has a downwardly axially extending rotary motor shaft 52 engaging fan hub 54.

Figure 3:
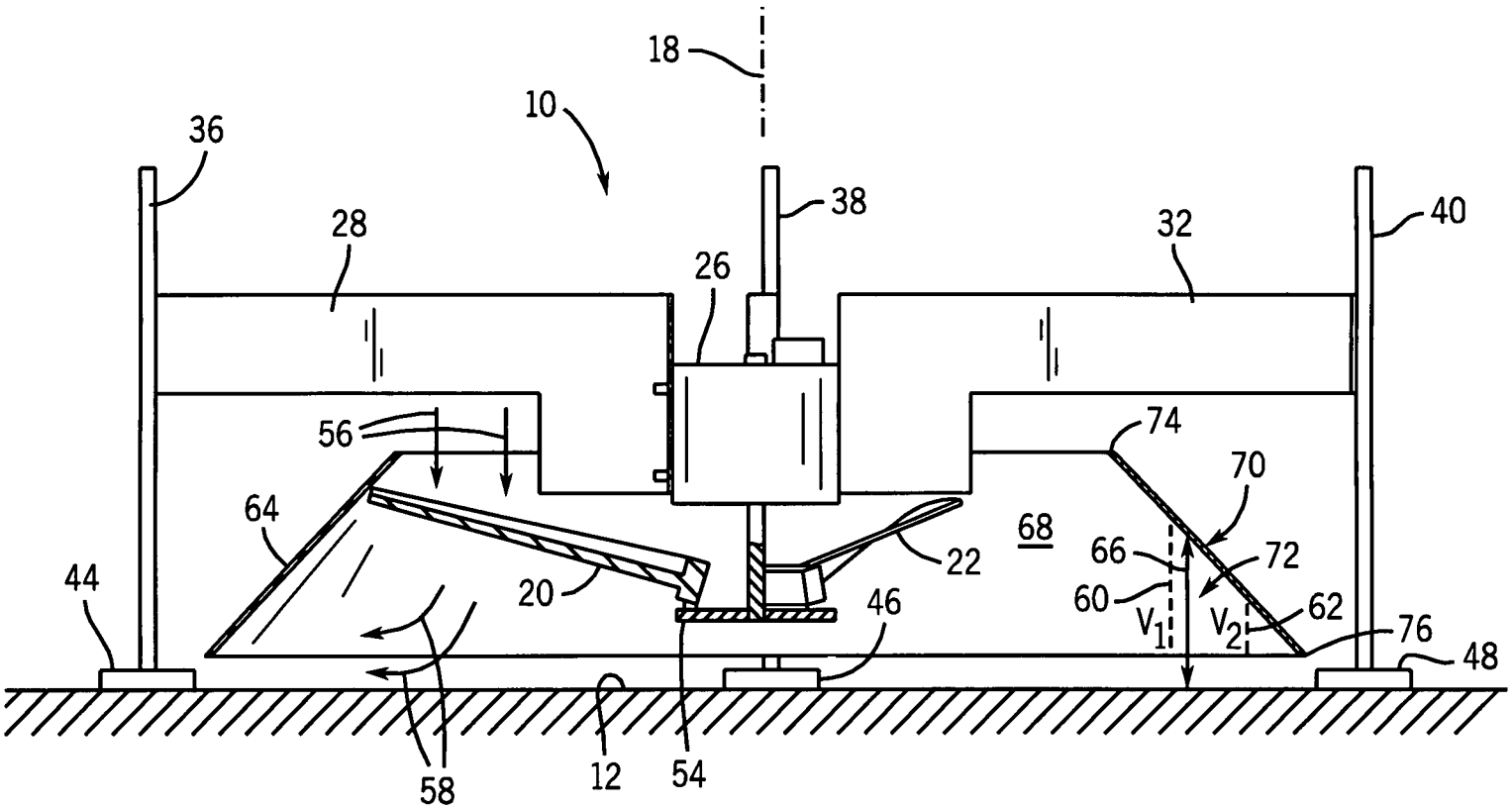
FIG. 3 is a sectional view taken along line 3-3 of FIG. 2.

During operation and rotation of the fan blades, air flows axially downwardly as shown at arrows 56, FIG. 3, and then radially outwardly as shown at arrows 58. The driven air has a velocity $V_0$ immediately adjacent the fan blades, a velocity $V_1$ radially outwardly of the blades at a first circumference 60 therearound, and a velocity $V_2$ further radially outwardly of the blades at a second circumference 62 around the noted first circumference. The housing has a shroud 64 extending radially outwardly of the fan blades and axially spaced from surface 12 by an annular gap 66 therebetween and defining an annulus 68 providing an air flow channel. The shroud has a shape selected to minimize differential velocity between $V_0$ and $V_1$ and $V_2$. In the preferred embodiment, $V_0$ equals $V_1$ equals $V_2$. Shroud 64 has a taper 70 selected to provide a narrowing venturi 72 to maintain substantially constant air flow velocity from first circumference 60 to second circumference 62 notwithstanding the larger fan-out radial dimension of the latter. Surface 12 is typically a flat horizontal surface. Annular gap 66 has an axial height between shroud 64 and surface 12 including a first axial height $H_1$ at first circumference 60, and a second axial height $H_2$ at second circumference 62. First circumference 60 is radially spaced from the axis of rotation 18 by a first radius $R_1$, and second circumference 62 is radially spaced from axis 18 by a second radius $R_2$. In the preferred embodiment $$\frac{R_1}{R_2} = \frac{H_2}{H_1}.$$

This has been found to provide improved fluid dynamics of the air flow through the fan, providing high air flow velocity for rapid water evaporation, and efficient fan operation.

Shroud 64 extends radially outwardly of the fan blades and is tapered relative to axis 18 and relative to the noted radial direction 58. The shroud has an annular shape having an inner circumference 74 of a first radius, and an outer circumference 76 of a, second radius greater than the noted radius of inner circumference 74. Inner circumference 74 is an air inlet, and outer circumference 76 is an air outlet. Air flows axially inwardly as shown at arrows 56 towards the fan blades at the inlet, and air flows radially outwardly away from the fan blades at outlet 76. Motor 26 is axially spaced from the fan blades along a first axial direction, e.g. upwardly in FIG. 1. Shroud 64 tapers at 70 radially outwardly and axially in a second axial direction, e.g. downwardly in FIG. 1, from inner circumference 74 to outer circumference 76. The noted second axial direction is opposite to the noted first axial direction. In the preferred embodiment, the shroud as a frusto-conical shape. Further in the preferred embodiment, the taper 70 of the shroud is rectilinear as it extends radially outwardly and axially from inner circumference 74 to outer circumference 76. Alternatively, the taper may have other shapes along such extension, e.g. arcuate, bell-shaped, and so on.

Figure 4:
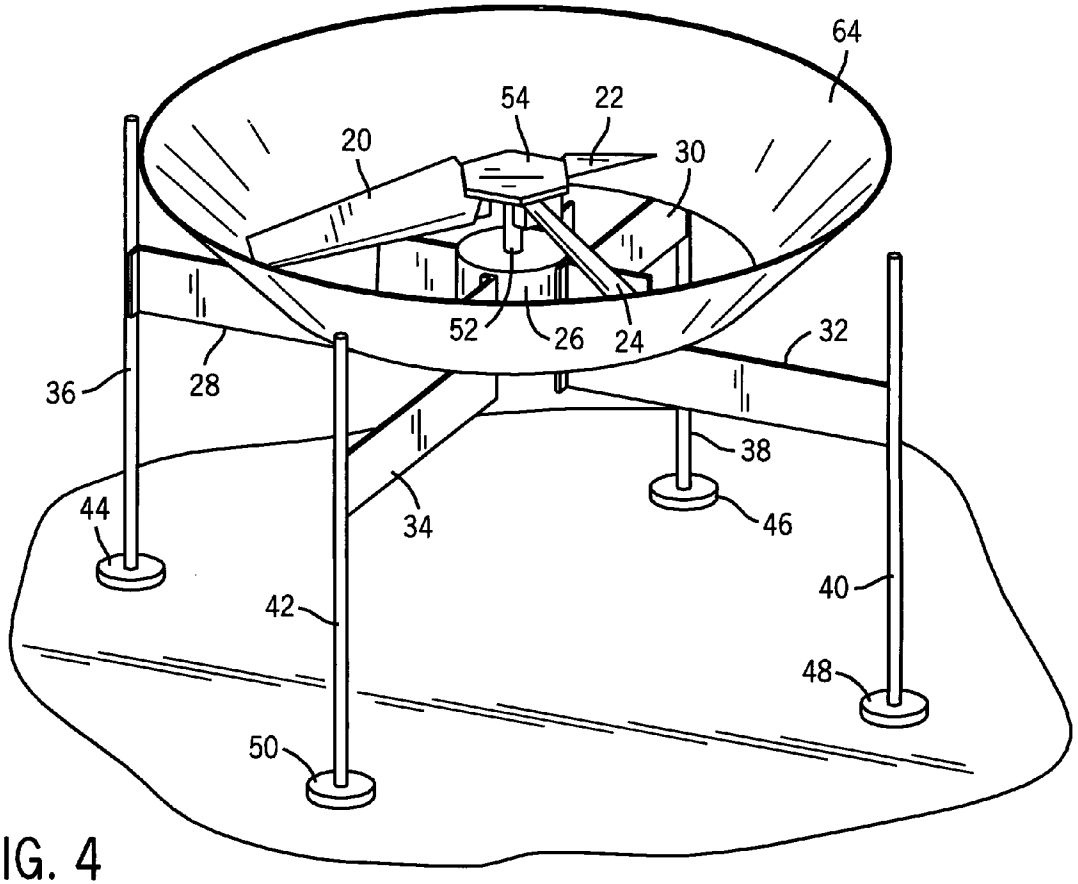
FIG. 4 is a perspective view showing another embodiment.

FIG. 4 shows another embodiment and uses like reference numerals from above where appropriate to facilitate understanding. Feet or pads 44, 46, 48, 50 are provided at the other ends of respective legs 36, 38, 40, 42 to reverse the vertical orientation of the fan to provide a fan for drying a ceiling. In further embodiments, the fan may be adapted for drying a wall, or other surfaces.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations described herein may be used alone or in combination with other configurations. It is expected that various equivalents, alternatives and modifications are possible within the scope of the appended claims.

What is claimed is:

1. A drying fan for drying a surface comprising a housing, a motor driven fan supported on said housing for rotation about an axis and having fan blades directing air radially relative to said axis, said air having a velocity $V_0$ immediately adjacent said blades, a velocity $V_1$ radially outwardly of said blades at a first circumference therearound, and a velocity $V_2$ further radially outwardly of said blades at a second circumference around said first circumference, said housing comprising a shroud extending radially outwardly of said blades and axially spaced from said surface by an annular gap therebetween defining an annulus providing an air flow channel, wherein said shroud has a shape selected to minimize differential velocity between $V_0$ and $V_1$ and $V_2$, wherein said shroud has a taper selected to provide a narrowing venturi to maintain substantially constant air flow velocity from said first circumference to said second circumference notwithstanding the larger fanned-out dimension of the latter.

2. The drying fan according to claim 1 wherein $V_0=V_1=V_2$.

3. The drying fan according to claim 1 wherein said surface is a flat horizontal surface.

* * * * *